US007743624B2

(12) United States Patent
Schneller et al.

(10) Patent No.: US 7,743,624 B2
(45) Date of Patent: Jun. 29, 2010

(54) BEVERAGE DISPENSE FONT INCORPORATING PORTABLE COOLING DEVICE

(75) Inventors: Lynette S. Schneller, Broomfield, CO (US); David Milliken, Denver, CO (US); Kevin Winters, Golden, CO (US)

(73) Assignee: Millercoors LLC, Milwaukee, WI (US)

( * ) Notice: Subject to any disclaimer, the term of this patent is extended or adjusted under 35 U.S.C. 154(b) by 553 days.

(21) Appl. No.: 11/669,049

(22) Filed: Jan. 30, 2007

(65) Prior Publication Data

US 2008/0178607 A1 Jul. 31, 2008

(51) Int. Cl.
*B67D 5/62* (2006.01)

(52) U.S. Cl. ..... 62/389; 222/146.6

(58) Field of Classification Search ..... 62/1, 62/389–390, 342; 222/146.6
See application file for complete search history.

(56) References Cited

U.S. PATENT DOCUMENTS 4,002,273 A 1/1977 Golding et al.
4,351,157 A * 9/1982 Zeigler ..... 62/1
4,720,076 A 1/1988 Hyde
4,949,552 A 8/1990 Adams
5,484,015 A 1/1996 Kyees
5,511,692 A 4/1996 Willingham
5,537,825 A 7/1996 Ward
5,564,602 A 10/1996 Cleland et al.
5,586,691 A 12/1996 Gotch et al.
5,634,343 A 6/1997 Baker, III
5,653,118 A * 8/1997 Cocchi et al. ..... 62/197
5,694,787 A 12/1997 Cleleand et al.
5,732,856 A 3/1998 Fry
5,743,107 A 4/1998 Kyees
6,098,418 A 8/2000 Kyees
6,138,995 A 10/2000 Page
6,324,850 B1 12/2001 Davis
6,378,313 B2 4/2002 Barrash (Continued)

FOREIGN PATENT DOCUMENTS

CA 2504120 9/2005

(Continued)

OTHER PUBLICATIONS

International Search Report for International (PCT) Patent Application No. PCT/US07/82808, mailed May 7, 2008.

(Continued)

*Primary Examiner*—William E Tapolcai
(74) *Attorney, Agent, or Firm*—Sheridan Ross PC

(57) ABSTRACT

A beverage dispense font incorporating a portable cooling device is provided wherein the portable cooling device cools an outer housing of the dispense font in order to encourage ice formation on the dispense font. Unique visual effects can be obtained with ice formation on the outer housing of the dispense font, and the portable cooling device therefore enables independent cooling of the outer housing without redesign or modification of the existing glycol cooling system used to cool the dispensed beverage.

The portable cooling device can be inherently small in size due to relatively minimal cooling capacity requirements for cooling just the outer housing of the dispense font. The dispense font and portable cooling device may be moved from location to location thereby greatly enhancing the capability to provide a frozen-appearing dispense font to many locations.

7 Claims, 5 Drawing Sheets

U.S. PATENT DOCUMENTS

| | | | |
|---|---|---|---|
| 6,431,403 | B1 | 8/2002 | Davis |
| 6,478,200 | B1 | 11/2002 | Davis |
| 6,481,216 | B2 | 11/2002 | Simmons et al. |
| 6,487,873 | B2 | 12/2002 | Kyees |
| 6,546,737 | B1 | 4/2003 | Heyes et al. |
| 6,553,782 | B1 | 4/2003 | Kyees |
| 6,598,417 | B1 | 7/2003 | Wilkes |
| 6,609,391 | B2 | 8/2003 | Davis |
| 6,648,025 | B2 | 11/2003 | Smith et al. |
| 6,698,229 | B2 | 3/2004 | Renken et al. |
| 6,901,427 | B2 | 5/2005 | Teshima |
| 6,966,458 | B2 | 11/2005 | Robinson |
| 7,013,668 | B2 | 3/2006 | Kyees |
| 2003/0070446 | A1 | 4/2003 | Scullion et al. |
| 2003/0201644 | A1 | 10/2003 | Kaploun |
| 2004/0099688 | A1 | 5/2004 | Davis |
| 2004/0129341 | A1 | 7/2004 | Anderson et al. |
| 2004/0133495 | A1 | 7/2004 | Bosch et al. |
| 2004/0168465 | A1 | 9/2004 | Renken et al. |
| 2005/0028964 | A1 | 2/2005 | Cleland |
| 2005/0097909 | A1 | 5/2005 | Cleland |
| 2005/0145826 | A1 | 7/2005 | McClung |
| 2006/0168987 | A1 | 8/2006 | Kyees |
| 2006/0272348 | A1 | 12/2006 | Kyees et al. |

FOREIGN PATENT DOCUMENTS

| | | |
|---|---|---|
| WO | 2006/016182 | 2/2006 |

OTHER PUBLICATIONS

Written Opinion for International (PCT) Patent Application No. PCT/US07/82808, mailed May 7, 2008.

"Welcome to COOLMATIC.NET.", available at http://www.coolmatic.net/, 2 pages, printed Oct. 3, 2006.

"Coolmatic CF-35 AC/DC, Capacity 33 Quarts (1.2 Cu/FT)", available at http://www.coolmatic.net/coolmatic__cf__35.html, 1 page, printed Oct. 3, 2006.

"Portable Refrigerator/Freezers", available at http://www.boatelectric.com/Waeco%20models.htm, 6 pages, printed Oct. 3, 2006.

Micro Matic Beer Equipment, product listing for Ice Cobra models, Feb. 4, 2005, p. 1-3, accessed May 26, 2009 at http://web.archive.org/web/20050418063531/www.micromatic.com/category.php?cid=547.

Micro Matic Beer Equipment, "Ice Cobra—Ice Frosted Tower—Glycol Cooled—2 Faucet," Feb. 4, 2005, pp. 1-2, accessed May 26, 2009 at http://web.archive.org/web/20060521174221/www.micromatic.com/draft-keg-beer/towers-pid-MM1092F.html.

Micro Matic Beer Equipment, Product Information Sheet for Ice Cobra model MM1092F, Nov. 2007, pp. 1-2, accessed May 26, 2009 at http://www.micromatic.com/BackEndAdmin/uploads/spec-sheet-draft-tower-cobra-2-faucet-00122-D0507-1107.pd.

Micro Matic Beer Equipment, "Dispense Tower Portfolio," Micro Matic Catalog, 2007, p. 31.

* cited by examiner 10
70
72
30
74
48
48
76
40
30
36
48
36
34
34
38
76
78
38
80
80

BEVERAGE DISPENSE FONT INCORPORATING PORTABLE COOLING DEVICE

FIELD OF THE INVENTION

The present invention relates to beverage dispensing systems that cools the beverage to be dispensed, and more particularly to a dispense font or tower having a separate cooling device to cool the tower in order to create a desired visual effect on the tower such as formation of ice on the tower without burdening an existing glycol cooling system used to cool the beverage.

BACKGROUND OF THE INVENTION

Beverages such as beer must be maintained at a sufficiently cool temperature in order to prevent excessive foaming of the beer when it is dispensed from the tap. Pressure-fed beer dispense systems typically include a glycol cooling system or cooling deck that cools the beer as it is transferred from the beer keg to the dispense point. The dispense point typically includes a dispense font or tower having a small reservoir to hold a quantity of the beverage to be dispensed. The tower itself may be cooled by the glycol cooling system wherein a glycol supply line circulates cooled glycol through or around the tower. The reservoir is replenished as the beverage is dispensed, since the beverage is under pressure from the keg.

It is preferable to minimize the distance between the beer keg and the dispense point. However, depending upon the layout of the particular establishment in which the beverage is to be dispensed, in many circumstances the beverage supply line must be cooled for a considerable distance. Glycol cooling systems include a glycol circulation loop, a refrigeration source, and one or more heat exchangers whereby the beverage supply line comes in contact with the glycol circulation loop. A glycol cooling system certainly adds to the expense of providing a cooled beverage. The most common glycol cooling systems are used for dispensing beer at establishments such as restaurants and bars.

It is common for the dispense tower to have a particular shape or style that corresponds to the brewer's commercial identity. In other words, the tower many include the trademarks/logos of the brewer and may be shaped and sized to reflect other commercial characteristics of the brewer. Thus, certain non-functional or aesthetic features may be added to the exterior surface of the dispense tower and beer tap with the intention of clearly associating the identity of the brewer with the beverage being dispensed from the tower. One feature that has been recently developed for dispense towers is the formation of ice on the beer tower itself. The glycol cooling system sufficiently cools the housing or shell of the dispense tower such that moisture in the atmosphere surrounding the beer tower condenses on the beer tower surface, and then ultimately freezes. Thus, the beer tower appears as a frozen mass.

One disadvantage to present frozen dispense towers is that the dispense towers must be integrated within the closed loop glycol cooling system. Therefore, the particular style or type of dispense tower that is in use at any particular location cannot be modified without disconnecting the glycol cooling line, redesigning/replacing the tower, and then reconnecting the glycol cooling line. Additionally, cooling of the dispense tower by the glycol cooling system also places additional demands on the glycol cooling system. Depending upon the length of the beverage supply line, the cooling capacity of the glycol cooling system, and the size of the dispense tower, the beverage may not be kept adequately cooled if the dispense tower must also be cooled.

SUMMARY OF THE INVENTION

In order to overcome the disadvantages set forth above with respect to the prior art, and to provide greater flexibility with respect to provision of a frozen dispense tower, it is therefore desirable to provide a dispense tower that is not connected to or otherwise integrated with an existing glycol cooling system. Additionally, there is a need to provide a frozen dispense tower that has its own integral cooling source, thus making the frozen dispense tower truly portable so that it can be used at different locations without disturbing the existing glycol cooling systems. Additionally, there is a need to provide a dispense tower that can also provide some additional cooling of the beverage as it is held within the reservoir at the point of dispense.

In a preferred embodiment of the present invention, a dispense tower or font is provided with its own dedicated cooling source in the form of a small, compact cooling unit that is mounted directly adjacent the dispense font when in use. This cooling unit is completely separate from the existing glycol cooling system and has its own dedicated cooling line and refrigeration source. Specifically, the tower includes an interior shell that supports a traversing arrangement of a closed loop cooling line that adequately cools the entire outer surface area of the tower. The outer surface of the tower is defined by an outer housing that surrounds the interior shell. The dispense tower of the present invention is preferably co-located with the point of dispense reservoir and dispense tap. In one embodiment, the tower has a mating configuration allowing the tower to at least partially surround the point of dispense reservoir, such that the tower may provide some additional secondary cooling to the beverage in the reservoir. The interior shell of the tower may have a cavity adapted in size to accept the particular point of dispense reservoir that may be present. Alternatively, the dispense tower may simply surround the point of dispense reservoir, but not make contact therewith such that no cooling is provided to the reservoir.

The dispense tower and associated integral cooling unit are portable in that the dispense tower is configured to be easily separated from the point of dispense reservoir and tap. Additionally, the dispense tower includes its own base, enabling it to be mounted to any surface adjacent to the point of dispense reservoir and tap.

In one aspect of the invention, the invention may be considered a dispense tower with an integral cooling unit in order to create a decorative, frozen appearance for the tower. In another aspect of the invention, it may be considered a dispense tower in combination with a conventional beverage dispense system wherein the dispense tower may optionally provide additional cooling to the beverage located at the point of dispense reservoir and provides the decorative, frozen appearance.

In yet another aspect of the present invention a method of freezing a dispense tower is provided wherein the dispense tower and its associated cooling source are separated from the existing glycol cooling system, and secondary cooling can optionally be provided to the point of dispense reservoir.

These and other features and advantages of the present invention will become more apparent from a review of the following detailed description, taken in conjunction with the drawings.

DETAILED DESCRIPTION

Figure 1:
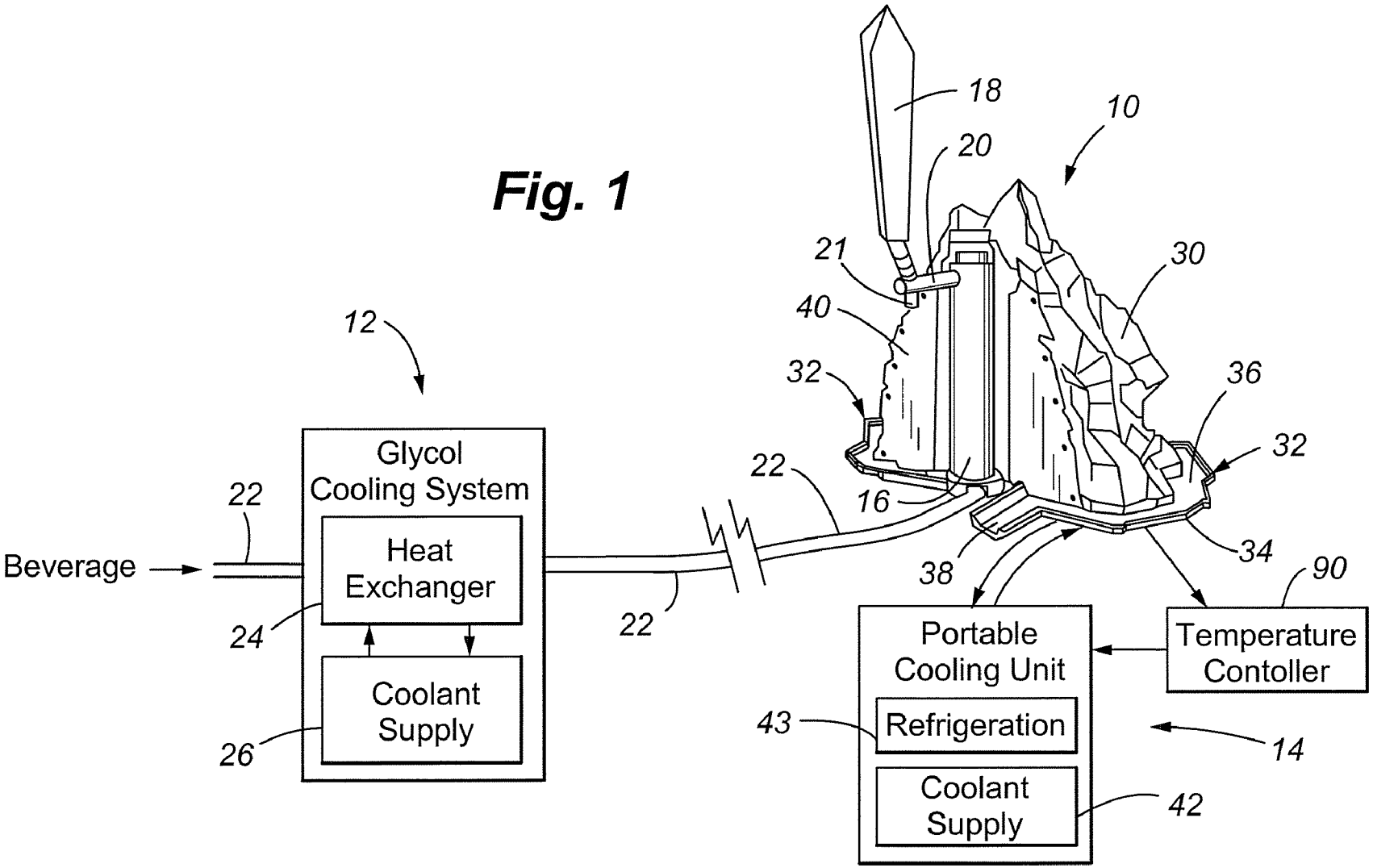
FIG. 1 is a perspective view of the beverage dispense font of the present invention, along with a schematic view of the portable cooling unit of the present invention, and a schematic view of a conventional glycol cooling system.

FIG. 1 illustrates a first embodiment of the beverage dispense font 10 incorporating the portable cooling device 14. Also shown is a conventional glycol cooling system 12 that cools the beverage supplied to the reservoir 16 mounted adjacent the dispense font 10. Activating tap handle 18 causes the beverage to flow from the reservoir 16 through the tap 20 and out from the spout 21. The beverage is supplied under pressure so that a constant flow of the beverage can be provided. As well understood by those skilled in the art, dispensing a beverage such as beer is achieved by pressurizing a beer keg located remote from the dispense font, and the glycol cooling system 12 provides cooling of the beverage supply line 22, such that the beer delivered to the reservoir 16 is at the desired temperature. The conventional glycol cooling system 12 is illustrated as including a heat exchanger 24 that allows heat transfer from the supply line to the coolant supply 26 circulated through the heat exchanger. The coolant supply 26 is cooled by a refrigeration source (not shown) integral with the cooling system 12. The heat exchanger may include one or more coils containing a coolant such as a glycol. Although the cooling system 12 is specifically disclosed as using glycol, it shall be understood that the cooling system 12 represents any prior art cooling system wherein the supply line 22 is cooled by a cooling system and some means is provided for allowing heat exchange to occur between the coolant line and a cooling source. Examples of prior art cooling systems include those disclosed in U.S. Pat. Nos. 4,949,552; 5,564,602; and 5,732,856, these references being hereby incorporated by reference for teaching conventional cooling systems used to cool a dispensed beverage such as beer.

Figure 3:
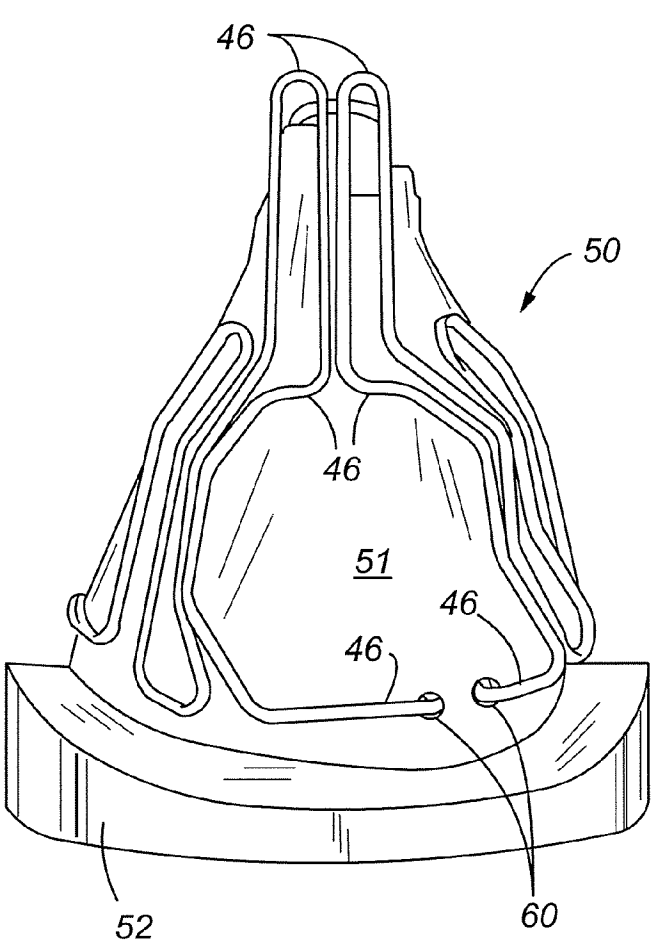
FIG. 3 is an elevation view of the interior shell and glycol circulating line of the dispense font.
Figure 2:
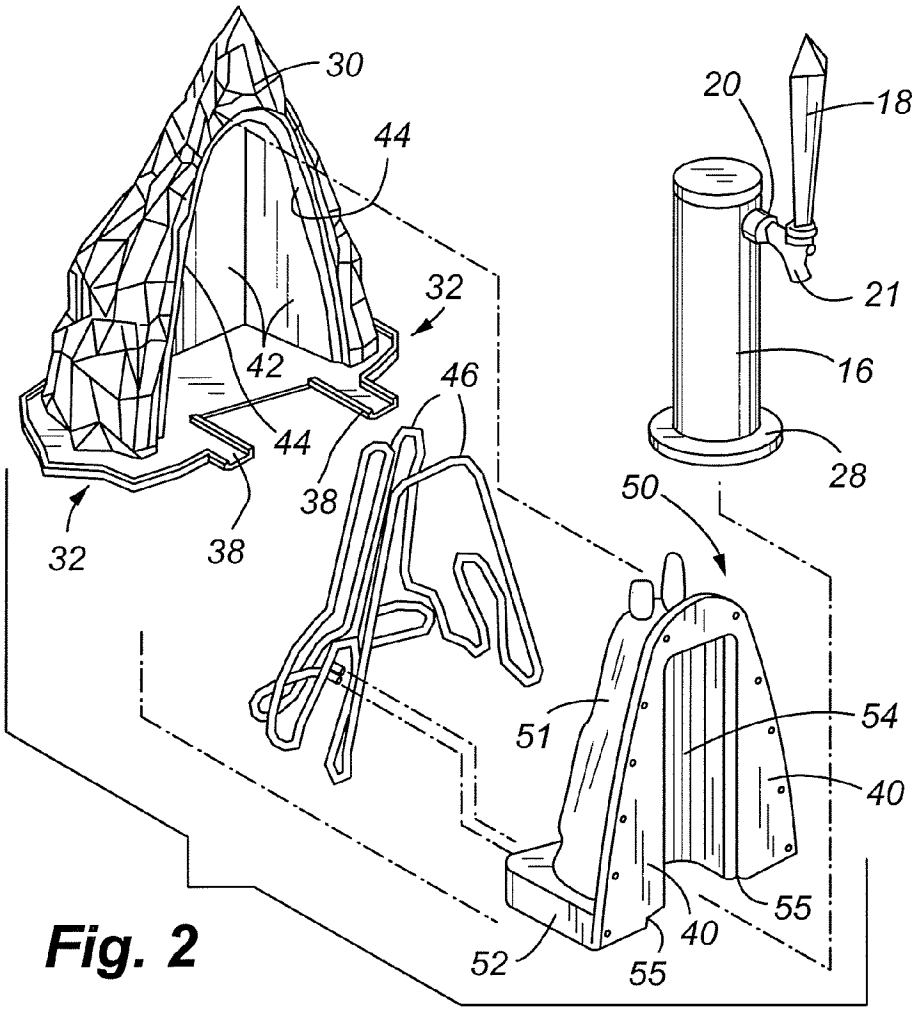
FIG. 2 is an exploded perspective view of the beverage dispense font of the present invention.

Referring also to FIGS. 2 and 3, further structural details of the dispense font are provided. The dispense font includes an outer housing 30 that is cooled and consequently, condensation forms on the outer housing and then freezes. In the example of FIG. 2, the outer housing 30 is in the shape of a mountain. However, it shall be understood that the particular shape of the outer housing 30 can be any shape which corresponds to some commercial aspect of the brewer, the establishment in which the beverage dispense font is installed, or any other desired shape. A condensation collection base 32 surrounds the lower portion of the outer housing 30. The collection base 32 has an outer lip or flange 34 and a trough 36 that catches liquid if the ice melts from the outer housing. Conveniently, two drain extensions 38 protrude from the collection base 32, and allow the liquid in the trough to drain as necessary.

The interior of the outer housing 30 is essentially hollow and inner surface 42 defines an interior cavity. Edge 44 defines a large central opening of the outer housing, which enables the interior shell 50 and cooling line 46 to be placed therein. The interior shell 50 may simply be a molded plastic piece that fits within the large central opening defined by edges 44 in the outer housing 30. The shell 50 has a conforming surface 51 that may substantially match the shape of the inner surface 42, thereby placing the cooling line 46 in close proximity to or in contact with the inner surface 42. Preferably, direct contact is made by the cooling line 46 with the inner surface 42 such that optimum heat transfer may occur from the outer housing 30. The cooling line 46 is formed in a pattern on the shell 50. Depending upon the extent to which the outer housing 30 must be cooled to cause condensation to freeze, the size, spacing, and particular configuration of the coolant line can be modified. The interior shell 50 also includes a base 52, and in the preferred embodiment of FIGS. 2 and 3, no coolant line surrounds the base. An exterior face 40 of the shell 50 is substantially planar as shown, and a plurality of fasteners 48 (see FIG. 6) secures the shell 50 near the edge 44 of the housing 30. A cylindrical shaped cavity 54 may be formed in the exterior face 40 in order to receive the reservoir 16. The reservoir typically has a lower flange 28 that is secured to the bar surface, and the lower portion of the cavity 54 includes a cutout 55 to accommodate the lower flange 28. As illustrated in FIG. 3, the cooling line 46 enters and exit through holes 60 formed in the conforming surface 51. Although the preferred embodiment illustrates a shell 50 having a particular shape and spacing with respect to the housing 30, it shall also be understood that the shell is not required and adequate cooling may be achieved by simply shaping the cooling line 46 such that it contacts or comes in close proximity to the inner surface 42 of the housing. In general terms, use of a cooling line 46 within the housing may be referred to herein as cooling means.

Figure 4:
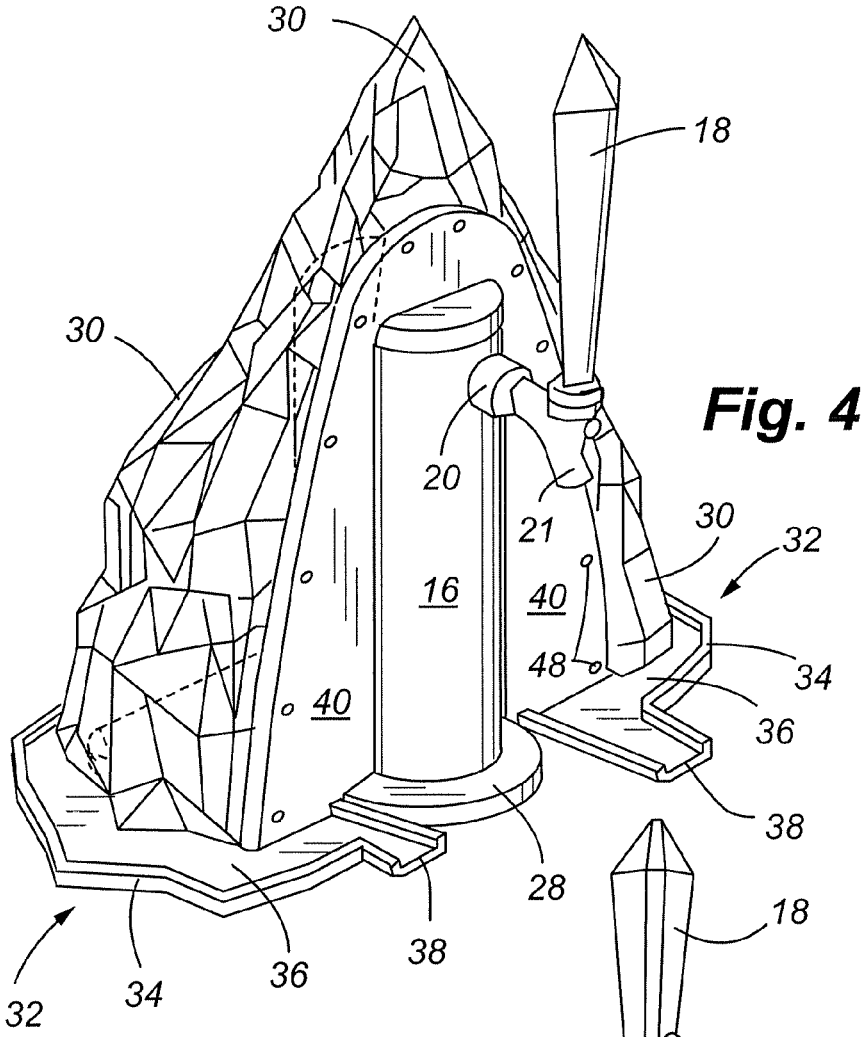
FIG. 4 is a rear perspective view of the beverage dispense font.
Figure 5:
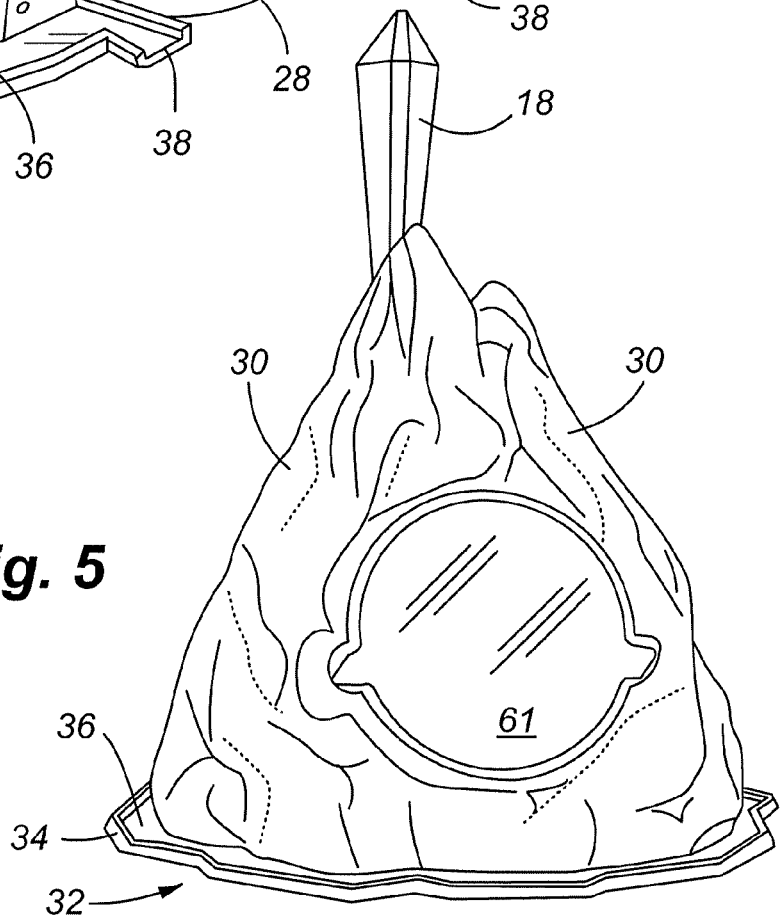
FIG. 5 is a front perspective view of the beverage dispense font.

Referring to FIG. 4, the dispense font is shown assembled with the reservoir 16 placed within the cavity 54. In the configuration of FIG. 4, some cooling may also be provided to the reservoir 16 by contact of the reservoir 16 with the cavity 54. If the interior shell 50 were made of metal as opposed to plastic, conduction characteristics would be improved thereby increasing the cooling effect for cooling the reservoir 16. However, if it is desired to insulate the reservoir 16 from any cooling provided by the cooling line 46, then molded plastic is a better choice of material since plastic is a better insulator.

Figure 6:
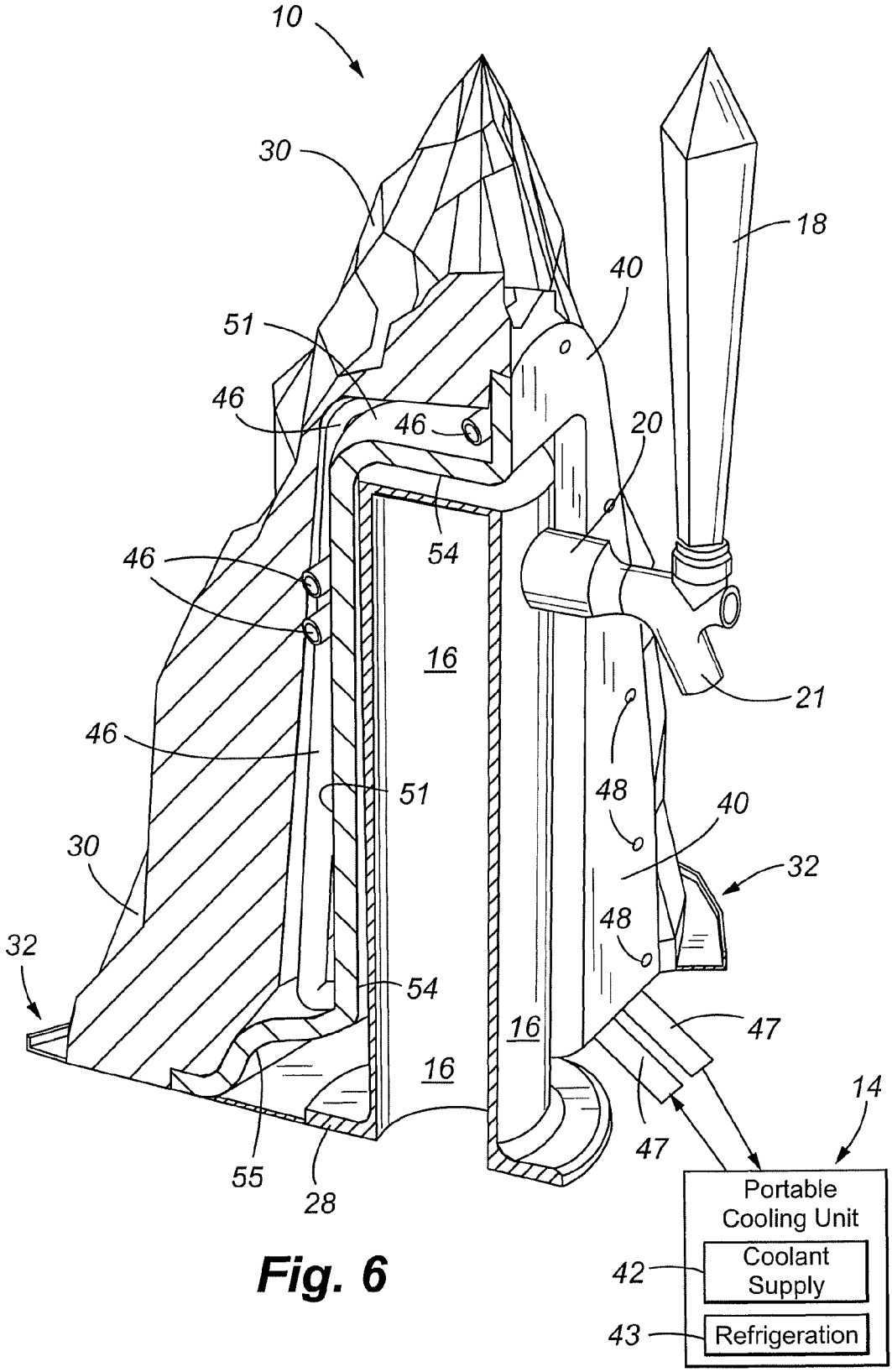
FIG. 6 is a fragmentary perspective view of the beverage dispense font illustrating interior details thereof.

Referring to FIG. 6, it is also seen that the outer housing 30 may also include a mount feature 61 formed on the outer surface. The mount 61 can be used to display the particular trademark/logo of the brewer or other party who wishes to be identified. Referring back to FIG. 3, it is therefore desirable to not form ice on area 61; therefore, cooling line 46 does not traverse at that corresponding location on the inner shell 50.

Referring to FIG. 6, further interior details of the invention are illustrated. As shown, the cooling line 46 are mounted to the exterior conforming surface 51 of the shell 50, thereby enabling efficient heat transfer from the outer housing 30 to the coolant line. The coolant line directly connects to the portable cooling unit 14 and the sections of the cooling line extending away from and to the font are shown as sections 47. The cooling unit 14 includes its own coolant supply 42, as well as a refrigeration source 43 that continually cools the coolant circulated through the cooling line 46. The refrigeration device 43 can be any small refrigeration device wherein a refrigerant line or chamber (not shown) cools the coolant supply. There are a number of commercial products that use very small refrigeration devices for purposes of cooling a desired space. For example, portable coolers with integral refrigeration devices such as those made by Coolmatic® of Ft. Lauderdale Fla. represent the type of small refrigeration devices available. Preferably, the portable cooling unit 14 is mounted directly below the dispense font 10, such as below the bar surface. The portable cooling unit is also preferably of such small size that it may be easily transported with the dispense font if it is necessary or desired to separate the dispense font from the point of dispense reservoir 16. Although glycol can be the coolant used in the portable cooling unit, it is contemplated that other coolants can also be used to include gas and liquids.

Figure 7:
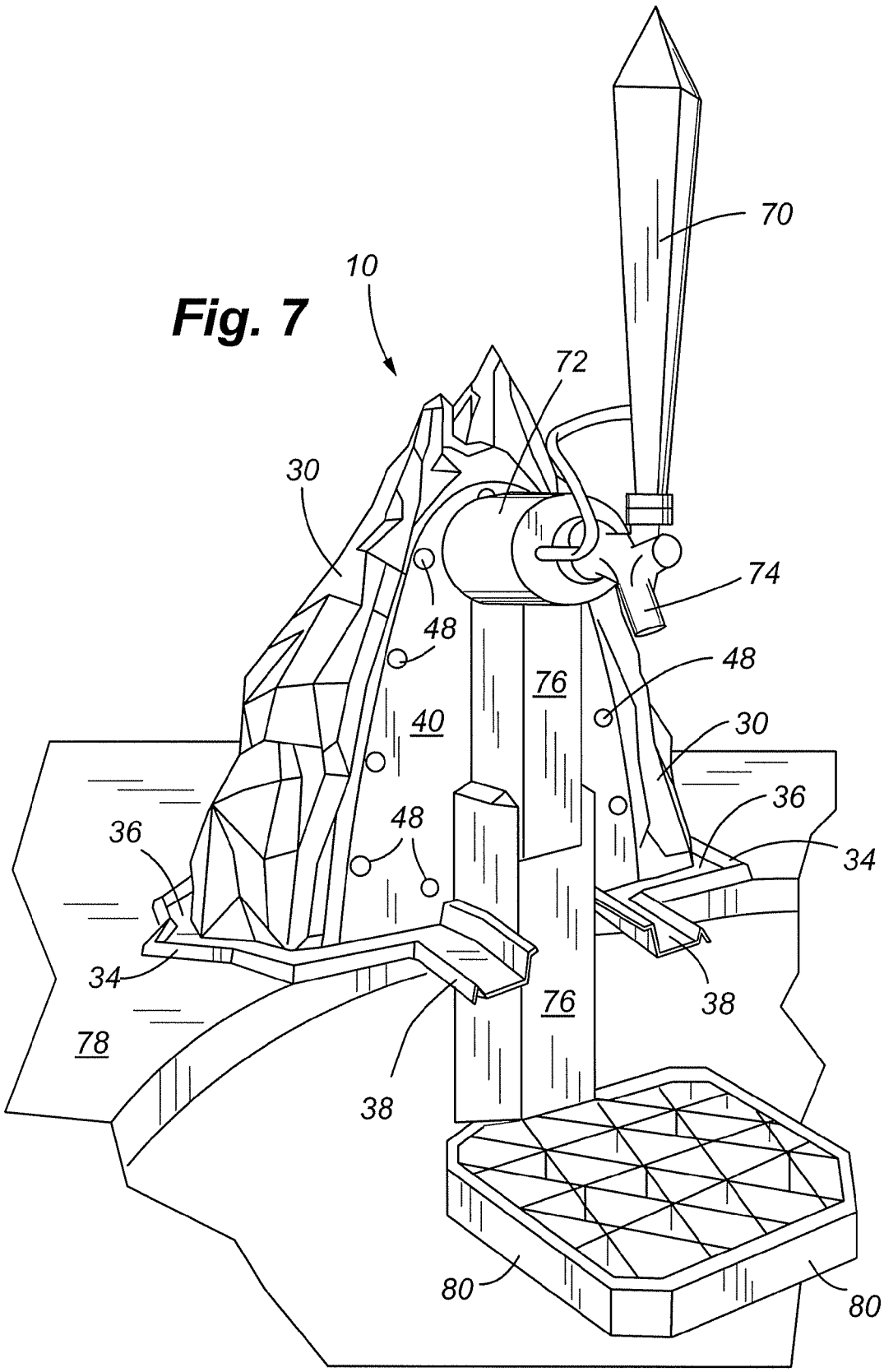
FIG. 7 is a rear perspective view of a second embodiment of the beverage dispense font of the present invention.

FIG. 7 illustrates another preferred embodiment of the present invention. The embodiment of FIG. 7 is similar to the first embodiment, with the exception of the particular style of the reservoir 76, spout 74, tap 72, and tap handle 70. Also in the embodiment of FIG. 7, the reservoir or column 76 is not contained within a cavity formed on exterior surface 40 but rather, is mounted exterior to the dispense font. Therefore, with the embodiment of FIG. 7, the sole purpose of the dispense font 10 is for producing ice on the outer housing 30. Additionally, a beverage rest 80 is shown wherein a beverage glass may be placed, and the drain extensions 38 are positioned such that condensation may flow into the beverage rest 80.

In accordance with the method of the present invention, a portable cooling unit is provided to separately cool the outer housing of the dispense font in order to cause ice to form on the outer housing. The portable cooling unit has its own dedicated cooling line that allow heat transfer from the outer housing to the dedicated cooling line. The dedicated cooling line may be supported on the interior shell that thereby maximizes surface contact of the interior of the housing with the cooling line. Sufficient cooling is provided to cause condensation to form on the outer housing, and as time progresses, the condensation freezes on the outer housing. As time further progresses, the amount of ice that forms on the outer housing will increase, and it may be desirable to control the thickness of the ice forming in order to achieve the desired visual effect. Therefore, it is also contemplated that the portable cooling unit may be cycled on and off such that the desired thickness of ice is maintained, thereby producing the desired visual effect on the outer housing. A temperature controller 90 may be used with the portable cooling unit to monitor the temperature inside the housing and to establish a desired cooling cycle to selectively freeze and thaw the condensation. An RTD or other temperature sensing devices (not shown) can be placed adjacent the cooling line to provide an input to the temperature controller. In turn, the temperature controller can then control the activation and on-off cycling of the portable cooling unit. By use of such a temperature controller, the thickness of the ice can be controlled over time. During start-up, it may be desirable to periodically brush the outer surface of the housing with water to encourage ice formation.

There are numerous advantages to the beverage dispense font and portable cooling device of the present invention. An existing glycol cooling system can remain in place without modification, yet a decorative, frozen appearing dispense font may be provided and installed at any desired location where a beverage is dispensed. The portable cooling unit can be a very small device, since the length of the coolant line is relatively small as compared to a conventional glycol cooling system. Some additional cooling benefit may be provided to the point of dispense tower if desired.

What is claimed is:

1. In combination, a beverage dispense font and a beverage dispense system comprising:

a housing having a central opening and an interior cavity defined by an inner surface;

a base secured to said housing;

an interior shell having a portion thereof placed inside said housing, and said interior shell having an exposed exterior face and an exterior cavity formed on the exterior face;

cooling means including at least one cooling line routed through said interior cavity and placed in a heat exchange relationship with said housing in order to cool said housing;

a portable cooling unit connected to said cooling line wherein a coolant circulates through said cooling line from said portable cooling unit;

a dispense reservoir placed adjacent to said housing and having a portion thereof disposed in said exterior cavity;

a beverage supply line providing a supply of beverage to said dispense reservoir;

a tap placed in fluid communication with said dispense reservoir;

a tap handle for operating said tap to selectively dispense a beverage from said tap;

a cooling system placed in heat exchange relationship with said beverage supply line for cooling a beverage in the supply line, said cooling system comprising at least one heat exchanger enabling heat transfer from said beverage supply line to a coolant supply incorporated in said cooling system.

2. The combination, as claimed in claim 1, wherein:

said base includes an outer lip and a trough extending between said outer lip and said housing, said trough for catching condensation forming on said housing.

3. The combination, as claimed in claim 1, further including:

a mount feature formed on an outer surface of said outer housing.

4. A method of freezing a dispense font secured to a dispense reservoir, said method comprising the steps of:

(a) providing a beverage dispense system comprising:

(i) a housing having a central opening and an interior cavity defined by an inner surface, said housing including an interior shell and said interior shell having an exterior face with an exterior cavity formed thereon;

(ii) a base secured to said housing;

(iii) cooling means including at least one cooling line routed through said interior cavity and placed in a heat exchange relationship with said housing in order to cool said housing;

(iv) a portable cooling unit connected to said cooling line wherein a coolant circulates through said cooling line from said portable cooling unit;

(v) providing a dispense reservoir and a tap for dispensing a beverage, said dispense reservoir placed in engagement with said interior cavity of said interior shell;

(b) operating said portable cooling unit to cool an exterior surface of said housing causing condensation to form on said exterior surface of said housing;

(c) further operating said portable cooling unit causing the condensation to freeze on said exterior surface; and (d) dispensing a beverage by operating said tap.

5. A method, as claimed in claim 4, further including the step of:

controlling a rate at which ice forms on said exterior surface of said housing by intermittently cycling said portable cooling unit on and off.

6. A method of dispensing a beverage from a dispense font and simultaneously freezing an exterior surface of said dispense font, said method comprising the steps of:

(a) providing a dispense font comprising:

(i) a housing having a central opening and a first interior cavity defined by an inner surface;

(ii) a cooling line routed through said interior cavity and placed in a heat exchange relationship with said housing to cool said housing;

(iii) a portable cooling unit connected to said cooling line wherein a coolant circulates through said cooling line from said portable cooling unit; providing a beverage dispense system comprising:

(1) a reservoir holding an amount of a beverage to be dispensed;

(2) a beverage supply line providing a supply of beverage to the reservoir;

(3) a heat exchanger for cooling the beverage supply line, thereby placing the beverage supply to the reservoir at a desired temperature;

(b) dispensing the beverage from the reservoir by a tap communicating with said reservoir, said reservoir being separated from said housing within said first cavity and placed in engagement with a second cavity formed on an exterior face of said housing;

(c) operating the portable cooling unit to cool an exterior surface of the housing causing condensation to form on the exterior surface of the housing; and (d) further operating the portable cooling unit causing the condensation to freeze on the exterior surface.

7. A method, as claimed in claim 6, further including the step of:

controlling a rate at which ice forms on the exterior surface of the housing by intermittently cycling the portable cooling unit on and off.

* * * * *